US007183704B2

(12) United States Patent
Kim et al.

(10) Patent No.: US 7,183,704 B2
(45) Date of Patent: Feb. 27, 2007

(54) FLAT-TYPE FLUORESCENT LAMP DEVICE AND METHOD OF FABRICATING THE SAME

(75) Inventors: Jae Bum Kim, Kyongsangbuk-do (KR); Won Jong Lee, Taejeon-kwangyokshi (KR); Sa Kyun Rha, Taejeon-kwangyokshi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/747,070

(22) Filed: Dec. 30, 2003

(65) Prior Publication Data

US 2004/0150317 A1 Aug. 5, 2004

(30) Foreign Application Priority Data

Dec. 31, 2002 (KR) ..... 10-2002-0087875

(51) Int. Cl.
*H01J 1/62* (2006.01)

(52) U.S. Cl. ..... 313/485; 313/491

(58) Field of Classification Search ..... 313/485–494, 313/582, 585–587
See application file for complete search history.

(56) References Cited

U.S. PATENT DOCUMENTS 6,124,676 A * 9/2000 Salavin et al. ..... 315/169.4
6,246,171 B1 * 6/2001 Vollkommer et al. ..... 313/586
6,346,772 B1 * 2/2002 Nishiki et al. ..... 313/587
6,541,913 B1 * 4/2003 Mori et al. ..... 313/582
6,548,962 B1 * 4/2003 Shiokawa et al. ..... 315/169.4
6,583,554 B2 * 6/2003 Lee ..... 313/495
6,593,693 B1 * 7/2003 Takagi et al. ..... 313/586
6,762,549 B2 * 7/2004 Hitzschke et al. ..... 313/493
6,838,826 B2 * 1/2005 Lin et al. ..... 313/582
2004/0150318 A1 * 8/2004 Kim et al. ..... 313/491

FOREIGN PATENT DOCUMENTS

KR 2002-0071640 9/2002

* cited by examiner

*Primary Examiner*—Karabi Guharay
*Assistant Examiner*—Dalei Dong
(74) *Attorney, Agent, or Firm*—Morgan, Lewis & Bockius, LLP

(57) ABSTRACT

A flat-type fluorescent lamp device includes first and second substrates facing each other, a plurality of first electrodes on the first substrate disposed along a first direction, each first electrode having protrusions extending from both sides of the first electrode along the first direction, a plurality of second electrodes on the first substrate, the second electrodes each having concave portions that correspond to the protrusions of the first electrode and convex portions that correspond to regions between the protrusions of the first electrode, a first fluorescent layer on an entire surface of the first substrate including the first and second electrodes, and a second fluorescent layer on the second substrate.

16 Claims, 5 Drawing Sheets

FLAT-TYPE FLUORESCENT LAMP DEVICE AND METHOD OF FABRICATING THE SAME

This application claims the benefit of the Korean Application No. P2002-87875 filed on Dec. 31, 2002, which is hereby incorporated by reference.

BACKGROUND OF THE INVENTION

1. Field of the Invention

The present invention relates to a fluorescent lamp device and a method of fabricating a fluorescent lamp device, and more particularly, to a flat-type fluorescent lamp device and a method of fabricating a flat-type fluorescent lamp device.

2. Discussion of the Related Art

In general, cathode ray tube (CRT) devices have been commonly used for display monitors in televisions, measuring instruments, and information display terminals. However, the CRT devices are bulky in size and relatively heavy, and cannot satisfy demands for miniaturization and low weight. Accordingly, many substitutes have been developed for replacing the CRT devices, include liquid crystal display (LCD) devices that make use of electro-optical effects, plasma display panel (PDP) devices that use gas discharge, and electro-luminescence display (ELD) devices that make use of an electric field luminous effect. Among the many different display devices, the LCD devices are being developed to have low power consumption, thin profile, and lightweight for application in monitors for desktop and laptop computers.

Most LCD devices control light transmittance from ambient light to display an image. However, it is necessary to form an additional light source, such as a backlight unit, in an LCD panel. Generally, the backlight unit includes cylindrical fluorescent lamp devices that may be classified into two different types: direct-type devices and edge-type devices.

The direct-type backlight devices are suitable for large-sized LCD devices of 20 inches or more, wherein a plurality of lamps are arranged along one direction below a light-diffusion plate to directly illuminate an entire surface of the LCD panel with light. Accordingly, the direct-type backlight devices having large light efficiencies and are commonly used for the large-sized LCD devices that require high luminance. However, the direct-type backlight devices are problematic in that silhouettes of the fluorescent lamps may be reflected onto the LCD panel. Accordingly, since a predetermined interval must be maintained between the fluorescent lamps and the LCD panel, a thin profile LCD device that uses the direct-type backlight device is difficult to obtain.

In the edge-type backlight devices, the fluorescent lamps are formed at one side of a light-guiding plate, and light is dispersed on an entire surface of the LCD panel by the light-guiding plate. Accordingly, the edge-type backlight devices are generally applied to relatively small-sized LCD devices, such as monitors for laptop and desktop computers. However, the edge-type backlight devices provide low luminance since the fluorescent lamps are provided at one side of the light-guiding plate, and the light is transmitted through the light-guiding plate. In addition, advanced techniques for designing and fabricating the light-guiding plate are required to obtain uniform luminous intensity in the LCD devices that use the edge-type backlight devices.

FIG. 1 is a cross sectional view of a backlight device according to the related art. In FIG. 1, a backlight device is formed below an LCD panel that displays image data (i.e., a picture). The backlight device includes a main supporter 1, a lower cover 3, a lamp assembly 10, a light-guiding plate 5, lower and upper light-diffusion plates 6 and 9, and lower and upper prisms 7 and 8. The main supporter 1 supports respective components of the backlight device, and the lower cover 3 protects the main supporter 1. In addition, a fluorescent lamp is provided in the lamp assembly 10, and the light-guiding plate 5 transmits the light emitted from the fluorescent lamp to the LCD) panel. Then, the lower and upper light-diffusion plates 6 and 9 are formed above the light-guiding plate 5 for diffusing the light incident on the light-guiding plate 5. The lower and upper prisms 7 and 8 condense the light diffused between the lower and upper light-diffusion plates 6 and 9, and transmit the condensed light to the LCD panel.

FIG. 2 is a perspective view of a backlight device according to the related art. In FIG. 2, a high-pressure lamp wire 13*a*, which is connected to a connector 16, and a low-pressure lamp wire 13*b* are respectively inserted into a high-pressure lamp holder 12*a* and a low-pressure lamp holder 12*b*. The respective lamp wires 13*a* and 13*b* are soldered, and the lamp holders 12*a* and 12*b* cover the soldering portions in the respective lamp wires 13*a* and 13*b*. Then, the lamp wires 13*a* and 13*b* are mounted in a lamp housing.

The lamp assembly is then assembled into the main supporter 1, and the lower cover 3 is assembled into the main supporter 1 to prevent the light incident portion of the main supporter 1 of the lamp assembly from being damaged due to external impact. Next, a reflecting plate 4 is mounted into an inner bottom of the main supporter 1, and the light-guiding plate 5 is mounted into the lamp housing 15 so that is has a uniform gap size and flatness. Subsequently, the lower light-diffusion plate 6, the lower prism 7, the upper prism 8 and the upper light-diffusion plate 9 are sequentially formed on the light-guiding plate 5.

When applying power to the fluorescent lamp by connecting the connector to a power supply, a glow discharge is generated within the fluorescent lamp, thereby emitting light. The light is incident on the light-guiding plate 5, and the incident light is reflected and scattered by printed dots on a lower surface of the light-guiding plate 5. The reflected and scattered light is condensed at a vertical direction by passing through the prism, and the condensed light is transmitted through the lower and upper light-diffusion plates 6 and 9, whereby the light is obliquely scattered. Accordingly, a rear portion of the LCD panel is irradiated with the light passing through the light-diffusion plate, and the reflecting plate 4 reflects the light that is not reflected or scattered by the printed dots of the light-guiding plate 5 to an upper direction.

However, the backlight device has the following disadvantages. The cylindrical fluorescent lamps in the backlight device are used as the light source and are formed at one side of the LCD device. Accordingly, it is difficult to obtain a uniform luminance across an entire surface of the LCD panel. In an attempt to obtain uniform luminance on the LCD panel with the backlight device, the light-guiding plate includes printed dots that are used for guiding the incident light to the upper direction. However, it is difficult to control the surface state of the light-guiding plate and the printed dots of the light-guiding plate. Thus, additional components are required that increase fabrication processing steps, thereby decreasing yield due to failures (i.e., bending or inaccurate sizing) of the light-guiding plate.

In addition, thermal expansion coefficients of the diffusion sheets are different from that of the components of the backlight device, thereby generating a ripple effect. For example, the light guiding plate has a higher hygroscopic property as compared with the main supporter, so that the size of the light-guiding plate may be easily changed. Thus, in case of the notebook computer having the backlight device, noise may be generated whenever the notebook computer is open or folded close.

Furthermore, it is hard to automate the fabrication process of the backlight device since it is important to prevent deposition of foreign particles within the backlight device, and to prevent scratches from being generating between the light-guiding plate and the diffusion sheets. Accordingly, manufacturing quality deteriorates and the yield decreases, and manufacturing costs increase.

SUMMARY OF THE INVENTION

Accordingly, the present invention is directed to a flat-type fluorescent lamp device and method of fabricating a flat-type fluorescent lamp device that substantially obviates one or more problems due to limitations and disadvantages of the related art.

An object of the present invention is to provide a flat-type fluorescent lamp device having an increased intensity of white light.

Additional features and advantages of the invention will be set forth in part in the description which follows, and in part will be apparent from the description, or may be learned by practice of the invention. The objectives and other advantages of the invention may be realized and attained by the structure particularly pointed out in the written description and claims hereof as well as the appended drawings.

To achieve these and other advantages and in accordance with the purpose of the present invention, as embodied and broadly described, a flat-type fluorescent lamp device includes first and second substrates facing each other, a plurality of first electrodes on the first substrate disposed along a first direction, each first electrode having protrusions extending from both sides of the first electrode along the first direction, a plurality of second electrodes on the first substrate, the second electrodes each having concave portions that correspond to the protrusions of the first electrode and convex portions that correspond to regions between the protrusions of the first electrode, a first fluorescent layer on an entire surface of the first substrate including the first and second electrodes, and a second fluorescent layer on the second substrate.

In another aspect, a flat-type fluorescent lamp device includes first and second substrates facing each other, a plurality of first electrodes on the first substrates extending along a first direction, each first electrode having protrusions extending from both sides of the first electrode at alternating positions along the first direction, a plurality of second electrodes on the first substrate, each second electrode having concave portions that correspond to the alternating protrusions of the first electrode, a first fluorescent layer on the first substrate including the first and second electrodes, and a second fluorescent layer on the second substrate.

In another aspect, a method of fabricating a flat-type fluorescent lamp device includes forming a plurality of first electrodes on a first substrate disposed along a first direction, each first electrode having protrusions extending from both sides of the first electrode along the first direction, forming a plurality of second electrodes on the first substrate, the second electrodes each having concave portions that correspond to the protrusions of the first electrode and convex portions that correspond to regions between the protrusions of the first electrode, forming a first fluorescent layer on an entire surface of the first substrate including the first and second electrodes, forming a second fluorescent layer on a second substrate, and attaching the first and second substrates together.

In another aspect, a method of fabricating a flat-type fluorescent lamp device includes forming a plurality of first electrodes on a first substrate extending along a first direction, each first electrode having protrusions extending from both sides of the first electrode at alternating positions along the first direction, forming a plurality of second electrodes on the first substrate, each second electrode having concave portions that correspond to the alternating protrusions of the first electrode, forming a first fluorescent layer on the first substrate including the first and second electrodes, forming a second fluorescent layer on a second substrate, and attaching the first and second substrates together.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
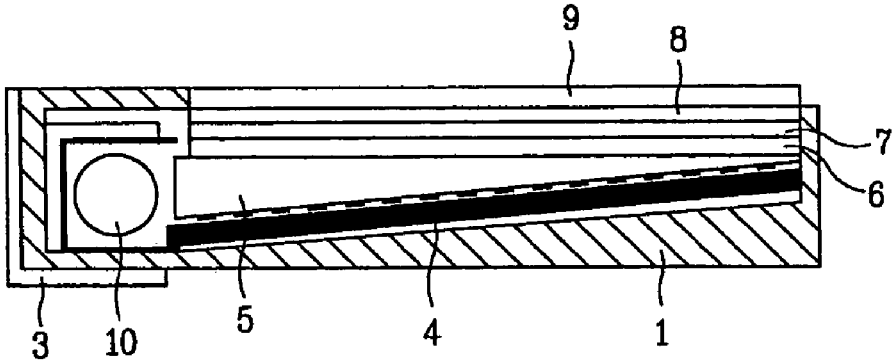
FIG.1 Related Art
FIG. 1 is a cross sectional view of a backlight device according to the related art.
Figure 2:
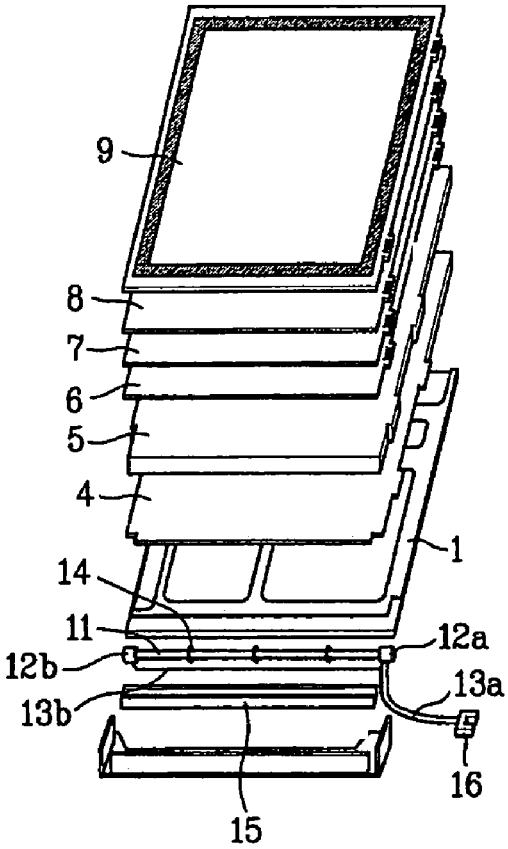
FIG.2 Related Art
FIG. 2 is a perspective view of a backlight device according to the related art.
Figure 3:
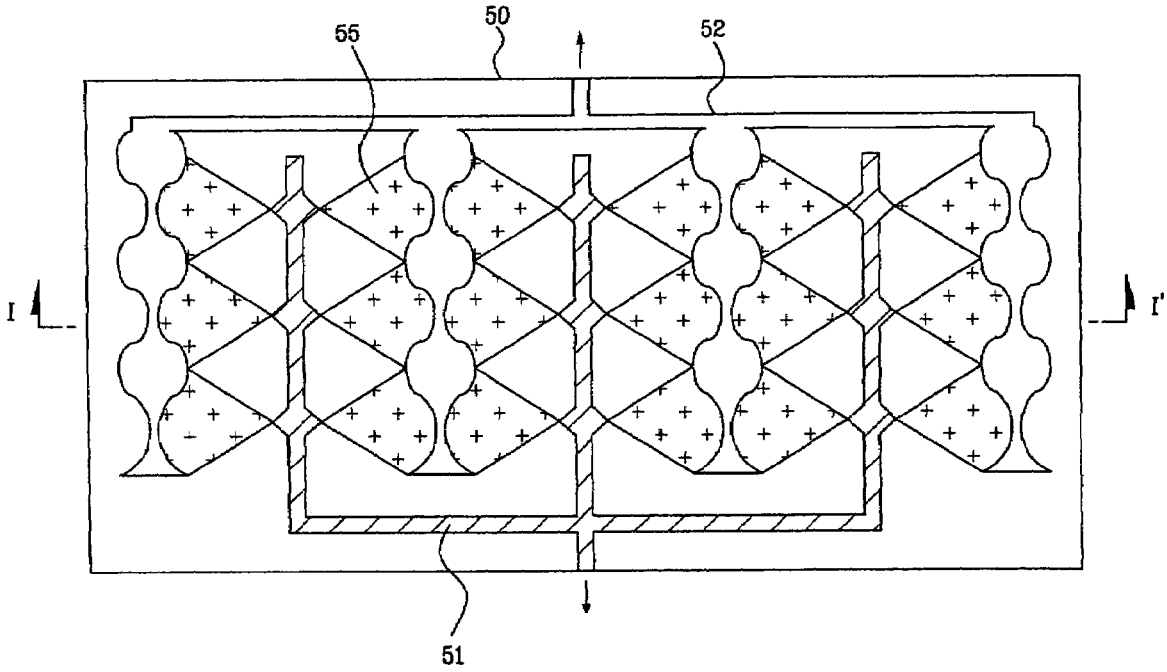
FIG. 3 is a plane view of an exemplary flat-type fluorescent lamp device according to the present invention.
Figure 5:
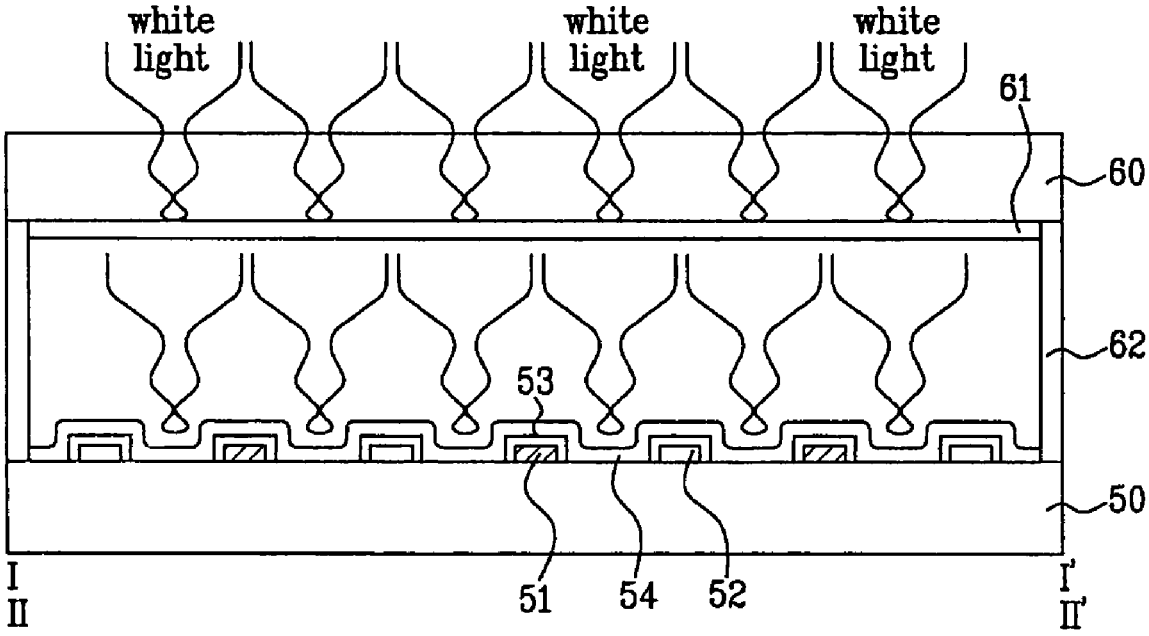
FIG. 5 is a cross sectional view along I–I' of FIG. 3 or along II–II' of FIG. 4 of the exemplary flat-type fluorescent lamp device according to the present invention.

FIG. 3 is a plane view of an exemplary flat-type fluorescent lamp device according to the present invention, and FIG. 5 is a cross sectional view along I–I' of FIG. 3 according to the present invention. In FIGS. 3 and 5, a flat-type fluorescent lamp device may include first and second substrates 50 and 60, a plurality of first and second electrodes 51 and 52, a barrier layer 53, a first fluorescent layer 54, and a second fluorescent layer 61. The first and second substrates 50 and 60 may be opposite each other, and the first and second electrodes 51 and 52 may be arranged on the first substrate 50 at fixed intervals. In addition, the barrier layer 53 may be formed to cover the first and second electrodes 51 and 52, the first fluorescent layer 54 may be formed on the barrier layer 53 and on the first substrate 50, and the second fluorescent layer 61 maybe formed on the second substrate 60.

The first electrodes 51 may be formed on the first substrate 50 at fixed intervals along one direction in which each first end of the first electrodes 51 may be connected to one another. In addition, triangular-type or semicircular-type protrusions may be formed from both sides of the respective first electrodes 51 at fixed intervals. Accordingly, the protrusions formed from both sides of the first electrode 51 may be symmetrical. The second electrodes 52 may be interposed between the first electrodes 51 at fixed intervals, and each first end of the second electrodes 52 may be connected to one another.

The second electrode 52 may include a plurality of concave portions that correspond to the protrusions of the first electrode 51 and may include a plurality of convex portions corresponding to regions between the protrusions of the first electrode 51. Accordingly, the second electrode 52 may be maintained at a constant distance from the first electrode 51. The convex portions of the second electrode 52 may be wider than the concave portions of the second electrode 52. Thus, the first electrode 51 may function as a cathode, and the second electrode 52 may function as an anode. Alternatively, the first electrode 51 may function as an anode, and the second electrode 52 may function as a cathode.

A supporter 62 (in FIG. 5) may be formed between the first and second substrates 50 and 60 for maintaining a uniform gap therebetween. The supporter may have a concave shape for improving light luminance in all directions, and may be formed of the same material as the first and second substrates 50 and 60, such as glass material(s) and heat-resistance material(s). In addition, a compound gas may be injected into the uniform gap between the first and second substrates 50 and 60. The compound gas may include at least one of Xe, Xe—Ne, and Xe—He gases.

The barrier layer 53 may be formed on surfaces of the first and second electrodes 51 and 52 to functions as a dielectric layer. In addition, the barrier layer 53 may prevent the first and second electrodes 51 and 52 from being damaged by electrons discharged from the first and second electrodes 51 and 52. Furthermore, the barrier layer 53 may function as a reflective layer for concentrating UV light. For example, the barrier layer 53 may include at least one of AlN, $BaTiO_3$, $SiN_X$, and $SiO_X$. In addition, the first and second electrodes 51 and 52 may include low resistance metals, such as silver Ag, chrome Cr, white gold Pt, and copper Cu.

A connector assembly connected to the flat-type fluorescent lamp device may be connected to a power supply to drive the flat-type fluorescent lamp device. Thus, electrons discharged from the glow discharge or from the first electrode 51 collide with the compound gas, thereby forming plasma. Accordingly, UV light is produced. When the UV light collides with the second fluorescent layer 61 deposited on the second substrate 60, white light is generated. The white light is reflected onto an entire surface of the first substrate 50 through the barrier layer 53 and the first fluorescent layer 54, wherein the barrier layer 53 may function as a reflective layer on the first substrate 50. In addition, delta-shaped UV light source regions 55 between each of the protrusions of the first electrodes 51 and the corresponding convex portions of the second electrode 52 are maximized, thereby improving luminance and intensity of the white light.

Figure 4:
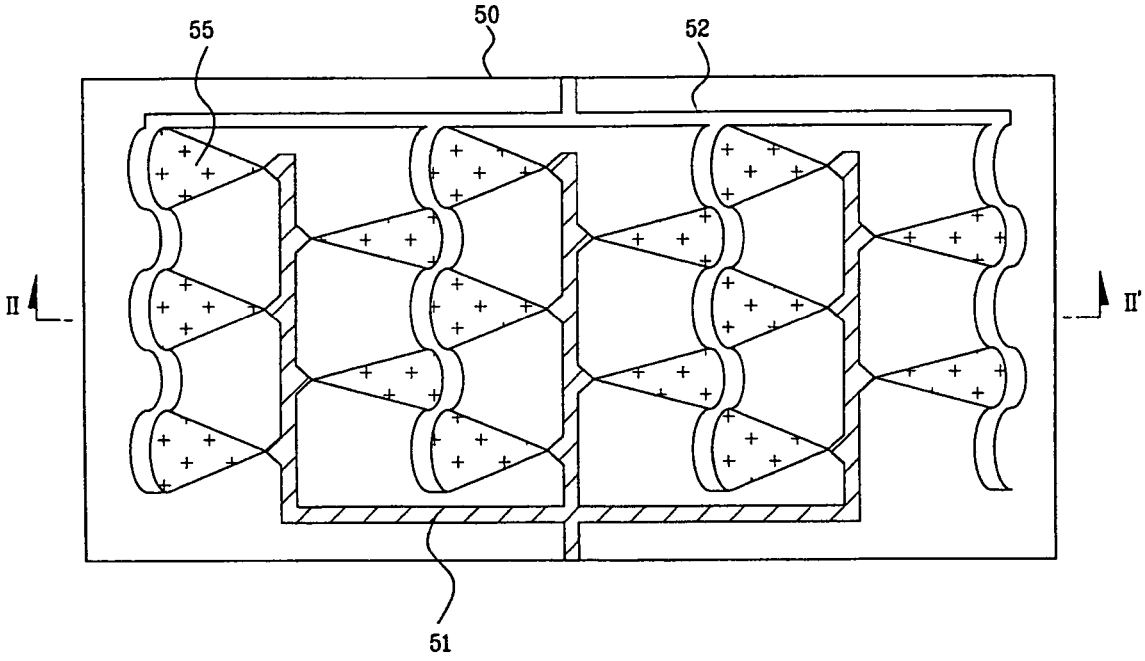
FIG. 4 is a plane view of another exemplary flat-type fluorescent lamp device according to the present invention.

FIG. 4 is a plane view of another exemplary flat-type fluorescent lamp device according to the present invention, and FIG. 5 is a cross sectional view along II–II' of FIG. 4 according to the present invention. In FIGS. 4 and 5, a flat-type fluorescent lamp device may include first and second substrates 50 and 60, a plurality of first and second electrodes 51 and 52, a barrier layer 53, a first fluorescent layer 54, and a second fluorescent layer 61. The first and second substrates 50 and 60 may be opposite to each other, and the plurality of first and second electrodes 51 and 52 may be arranged on the first substrate 50 at fixed intervals. The barrier layer 53 may be formed to cover surfaces of the first and second electrodes 51 and 52, the first fluorescent layer 54 may be formed on the barrier layer 53 and the first substrate 50, and the second fluorescent layer 61 may be formed on the second substrate 60. In addition, supporters 62 may be formed between the first and second substrates 50 and 60 for maintaining a uniform gap therebetween. The supporters 62 may include a concave shape for improving light luminance in all directions, and may be formed of the same material as the first and second substrates 50 and 60, such as glass material(s) and heat-resistance material(s). In addition, a compound gas may be injected into the uniform gap between the first and second substrates 50 and 60. The compound gas may include at least one of Xe, Xe—Ne, and Xe—He gases.

The first electrodes 51 may be formed on the first substrate 50 along one direction at fixed intervals, and each first end of the first electrodes 51 may be connected to one another. In addition, triangular-type or semicircular-type protrusions may be alternately formed from both sides of each first electrode 51. For example, the first electrode 51 may include a first side protrusion in a first portion thereof extending along a first direction, and may include a second side protrusion in a second portion thereof extending along a second direction opposite to the first direction. Accordingly, the first and second side protrusions of the first electrode 51 may be alternately formed along a length portion of the first electrode 51.

The second electrodes 52 may be interposed between the first electrodes 51 at fixed intervals, and each first end of the second electrodes 52 may be connected to one another. In addition, the second electrode 52 may be maintained with the first electrode 51 at the constant interval. For example, the second electrode 52 may include concave portions that correspond to the protrusions of the first electrode 51, whereby the constant distance is maintained between the first and second electrodes 51 and 52. Moreover, the second electrode 52 may have a constant width. The first electrode 51 may function as a cathode, and the second electrode 52 may function as an anode. Alternatively, the first electrode 51 may function as an anode, and the second electrode 52 may function as a cathode.

The barrier layer 53 formed on surfaces of the first and second electrodes 51 and 52 may function as a dielectric layer. In addition, the barrier layer 53 may prevent the first and second electrodes 51 and 52 from being damaged by electrons discharged from the first and second electrodes 51 and 52. Furthermore, the barrier layer 53 may function as a reflective layer for concentrating UV light. For example, the barrier layer 53 may include at least one of AlN, $BaTiO_3$, $SiN_X$, and $SiO_X$. In addition, the first and second electrodes 51 and 52 may include low resistance metals, such as silver Ag, chrome Cr, white gold Pt, and copper Cu.

A connector assembly connected to the flat-type fluorescent lamp device may be connected to a power supply, thereby supplying power to the flat-type fluorescent lamp device. Thus, electrons discharged from the glow discharge or the first electrode 51 collide with the compound gas, thereby forming plasma. As a result, UV light is produced. When the UV light collides with the second fluorescent layer 61 deposited on the second substrate 60, white light is produced. The white light is reflected on an entire surface of the first substrate 50 through the barrier layer 53 and the first fluorescent layer 54, wherein the barrier layer 53 may function as the reflective layer on the first substrate 50.

In the flat-type fluorescent lamp device, the concave portions of the second electrode 52 that correspond to the protrusions of the first electrode 51 may provide for a plurality of delta-shaped UV light regions 55 that may be maximized, thereby improving luminance and intensity of the white light.

Figure 6A:
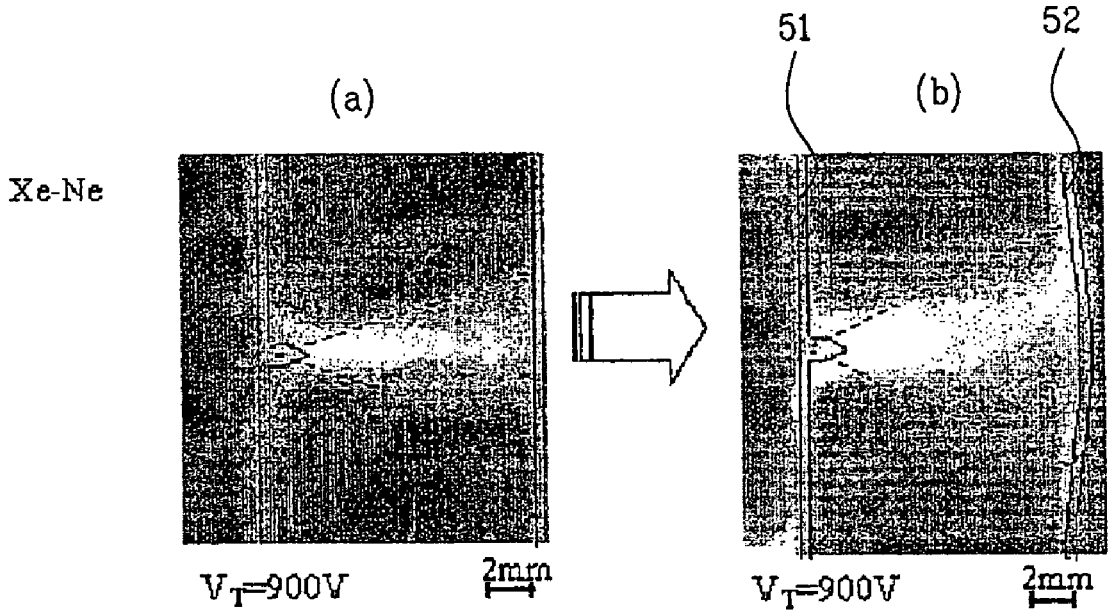
FIGS. 6A and 6B illustrate measurements of UV sources according to the present invention.
Figure 6B:
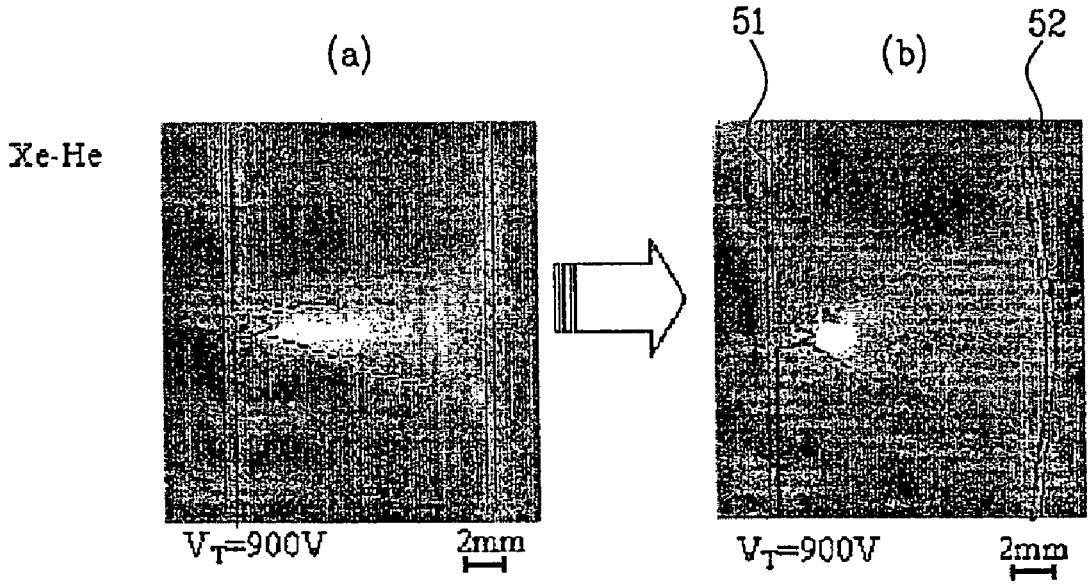

FIGS. 6A and 6B illustrate measurements of UV sources according to the present invention. In FIG. 6A(*a*), a second electrode has a flat surface that corresponds to a protrusion of a first electrode, and in FIG. 6A(*b*) a second electrode has a concave portion that corresponds to a protrusion of a first electrode. Accordingly, the UV light region in FIG. 6A(*a*) is relatively smaller than the UV light region in FIG. 6A(*b*) when a compound gas is injected that includes Xe—Ne.

In FIG. 6B(*a*), a second electrode has a flat surface that corresponds to a protrusion of a first electrode, and in FIG. 6B(*b*) a second electrode has a concave portion that corresponds to a protrusion of a first electrode 51. Accordingly, the UV light region in FIG. 6B(*a*) is relatively smaller than the UV light region in FIG. 6B(*b*) when a compound gas is injected that includes Xe—He.

In FIGS. 6A and 6B, a pressure of the compound gas is maintained at a pressure of 100 Torr, wherein the compound gas includes one of Xe(20%)-Ne or Xe(20%)-He, and an input pulse frequency is about 30 KHz. In addition, any one of Xe, Xe—Ne, and Xe—He compound gasses may be used. Moreover, a Xe input ratio is at 5% to 40%, a discharge pressure is at 60 torr to 140 torr, and an input voltage is at 600V to 1200V.

In the exemplary flat-type fluorescent lamp device according to the present invention, when the second electrode 52 includes concave portions that correspond to the protrusions of the first electrode 51, light efficiency (i.e., luminous intensity) is improved by about 35% or more, as compared to the second electrode 52 having a flat surface that corresponds to the protrusions of the first electrode 51. Accordingly, an emitting pattern of the UV light varies in accordance with the shape of the first and second electrodes 51 and 52.

Accordingly, an entire surface of the flat-type fluorescent lamp device may be used as the light source, thereby improving overall luminance and uniformity of light. In addition, various components, such as sheets, a main supporter, a light-guiding plate, and a lower cover, may not be required in the flat-type fluorescent lamp devices according to the present invention. For example, it may be possible to simplify fabrication process steps for the flat-type fluorescent lamp device of the present invention, thereby automating fabrication of the flat-type fluorescent lamp devices. Thus, device yields may be improved.

Furthermore, the light-guiding plate having printed dots may not be used in the flat-type fluorescent lamp devices according to the present invention. Thus, processes for forming the light-guiding plate designs and radiation patterns may not be required, thereby decreasing manufacturing costs.

Moreover, in the flat-type fluorescent lamp devices according to the present invention, the second electrode having the concave portions of the second electorde that that correspond to the protrusions of the first electrode maintain a constant distance between the first and second electrodes. Accordingly, the delta-shaped UV light regions are maximized, thereby improving the luminance and intensity of the white light.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A flat-type fluorescent lamp device, comprising:

first and second substrates facing each other;

a plurality of first electrodes on the first substrate disposed along a first direction, each first electrode having protrusions extending from both sides of the first electrode along the first direction;

a plurality of second electrodes on the first substrate, the second electrodes each having convex portions that correspond to the protrusions of the first electrode and concave portions that correspond to regions between the protrusions of the first electrode;

a first fluorescent layer on an entire surface of the first substrate including the first and second electrodes; and a second fluorescent layer on the second substrate, wherein the first fluorescent layer includes a plurality of convex portions each overlying one of the plurality of first and second electrodes and a plurality of concave portions each disposed between the plurality of first and second electrodes.

2. The device according to claim 1, wherein the protrusions of the first electrode are symmetrically formed from the both sides of the first electrode.

3. The device according to claim 2, wherein the convex portions of the second electrode are wider than the concave portions of the second electrode.

4. The device according to claim 1, wherein end portions of the first electrodes are connected to one another.

5. The device according to claim 1, wherein the second electrodes are interposed between the first electrodes at fixed intervals.

6. The device according to claim 5, wherein end portions of the second electrodes are connected to one another.

7. The device according to claim 1, wherein the protrusions of the first electrodes are one of triangular and semicircular shape.

8. The device according to claim 1, further comprising supporters between the first and second substrates to maintain a uniform gap between the first and second substrates.

9. The device according to claim 8, wherein sidewalls of the supporters are concave.

10. The device according to claim 1, further comprising a barrier layer covering surfaces of the first and second electrodes.

11. The device according to claim 10, the barrier layer includes at least one of AlN, $BaTiO_3$, $SiO_x$, and $SiN_x$.

12. The device according to claim 1, wherein the first and second substrates include at least one of glass materials and heat-resistance materials.

13. The device according to claim 1, wherein the first substrate includes at least one of a metal and an insulating material.

14. The device according to claim 1, wherein the first and second electrodes include at least one of Ag, Cr, white Pt, and Cu.

15. A flat-type fluorescent lamp device, comprising:

first and second substrates facing each other;

a plurality of first electrodes on the first substrate extending along a first direction, each first electrode having protrusions extending from both sides of the first electrode at alternating positions along the first direction;

a plurality of second electrodes on the first substrate, each second electrode having convex portions that correspond to the alternating protrusions of the first electrode;

a first fluorescent layer on the first substrate including the first and second electrodes; and a second fluorescent layer on the second substrate, wherein the first fluorescent layer includes a plurality of convex portions each overlying one of the plurality of first and second electrodes and a plurality of concave portions each disposed between the plurality of first and second electrodes.

16. The device according to claim 15, wherein the second electrode has a constant width along the first direction.

* * * * *